US011541506B2

(12) United States Patent
Pachaiyappan et al.

(10) Patent No.: US 11,541,506 B2
(45) Date of Patent: Jan. 3, 2023

(54) CHEMICAL MECHANICAL POLISHING (CMP) POLISHING HEAD WITH IMPROVED VACUUM SEALING

(71) Applicant: Systems On Silicon Manufacturing Co. Pte. Ltd., Singapore (SG)

(72) Inventors: Jayakumar Pachaiyappan, Singapore (SG); Wah Ann Tan, Singapore (SG)

(73) Assignee: Systems on Silicon Manufacturing Company Pte Ltd, Singapore (SG)

( * ) Notice: Subject to any disclaimer, the term of this patent is extended or adjusted under 35 U.S.C. 154(b) by 524 days.

(21) Appl. No.: 16/584,970

(22) Filed: Sep. 27, 2019

(65) Prior Publication Data

US 2021/0094146 A1 Apr. 1, 2021

(51) Int. Cl.
*B24B 37/32* (2012.01)
*B24B 37/10* (2012.01)
*B24B 37/20* (2012.01)

(52) U.S. Cl.
CPC ..... *B24B 37/32* (2013.01); *B24B 37/105* (2013.01); *B24B 37/20* (2013.01)

(58) Field of Classification Search
CPC ..... B24B 37/30; B24B 37/27; B24B 49/16; B24B 49/08
USPC ..... 451/41, 289, 398, 288, 285, 287
See application file for complete search history.

(56) References Cited

U.S. PATENT DOCUMENTS

| | | | | |
|---|---|---|---|---|
| 6,132,298 | A * | 10/2000 | Zuniga | B24B 37/30 451/288 |
| 6,422,927 | B1 * | 7/2002 | Zuniga | B24B 37/32 451/388 |
| 6,602,114 | B1 * | 8/2003 | Wang | B24B 37/32 451/41 |
| 6,755,726 | B2 * | 6/2004 | Chen | B24B 37/30 451/288 |
| 7,029,383 | B2 * | 4/2006 | Lee | B24B 37/30 451/388 |
| 10,672,631 | B2 * | 6/2020 | Mao | B24B 57/02 |

* cited by examiner

*Primary Examiner* — Joel D Crandall
*Assistant Examiner* — Robert F Neibaur
(74) *Attorney, Agent, or Firm* — Horizon IP Pte. Ltd.

(57) ABSTRACT

A CMP tool for polishing a semiconductor wafer is disclosed. The CMP tool includes a polishing head with a wafer carrier unit on which a wafer is mounted for polishing. The wafer carrier unit includes a support plate with a seal disposed on its sidewall. The seal improves sealing of the flexible membrane to the support plate. This improves reliability by avoiding slippage during the dechucking stage as well as wafer slippage during wafer loading stage, thereby avoiding wafer damage as well as non-uniform polishing.

16 Claims, 6 Drawing Sheets

200

100

CHEMICAL MECHANICAL POLISHING (CMP) POLISHING HEAD WITH IMPROVED VACUUM SEALING

FIELD OF THE INVENTION

The present disclosure relates to a reliable Chemical Mechanical Polishing (CMP) head used in polishing a wafer. In particular, the present disclosure relates to a CMP head with improved vacuum sealing.

BACKGROUND

As critical dimension CD continues to shrink, planarity of a wafer surface becomes more and more important. CMP is employed to provide a planar surface on a wafer during semiconductor processing. A CMP system includes a CMP head which holds a wafer which is to be polished by a polishing pad disposed on a rotatable platen. Vacuum pressure is employed to pick up the wafer and hold it in position on a carrier head for polishing.

We have observed that existing CMP polishing heads may exhibit leakage in the vacuum pressure with use. Since the pressure holding the wafer in place is quite low, it is difficult to identify when vacuum leakage occurs. For example, with high pressure, the sound of vacuum leakage can be heard. However, at low pressure, vacuum or pressure leakage is virtually silent and undetectable. Further, the leakage usually occurs and remains within the CMP polishing head. Such leakages are often undetected by the electronic pressure transducers which can only monitor leakages that escape out of the polishing head. Pressure leakage can lead to non-uniformity in the polishing process, negatively affecting the planarity of the wafer surface. In addition, leakage in vacuum or pressure can cause wafer slippage from the CMP head during processing or shifting of the wafer position during loading or unloading, which can damage the wafer.

Accordingly, there is a need to provide a CMP head with improved sealing, which reduces vacuum pressure leakage.

SUMMARY

Embodiments of the present disclosure generally relate to CMP polishing head which includes a seal to improve sealing, thereby reducing vacuum pressure leakage. In one embodiment, a method of processing a wafer on which a plurality of devices is formed includes loading the wafer onto a polishing head assembly of a CMP tool for polishing the wafer. The polishing head assembly includes a wafer carrier unit on which the wafer is loaded, and the wafer carrier unit includes a support plate having a first and second major support plate surfaces and a side surface. The second major support plate surface serves as a surface which supports the wafer while the side surface includes a seal region surrounding the support plate. The wafer carrier unit further includes a seal disposed on the seal region, a flexible support membrane which encases the support plate and covers the second major support plate surface while extending below the support plate. The seal is configured to improve sealing of the wafer carrier unit to reduce vacuum pressure leakage. The method continues with polishing the wafer by the CMP tool and unloading the wafer from the CMP tool. The seal which is disposed on the seal region of the support plate improves vacuum pressure sealing of the wafer carrier unit to reduce damaging the wafer during loading, polishing, and unloading.

In another embodiment, a device includes a polishing head assembly of a CMP tool which includes a wafer carrier unit on which a wafer is loaded for polishing and unloaded after polishing. The wafer carrier unit includes a support plate having a first and second major support plate surfaces and a side surface. The second major support plate surface serves as a surface which supports the wafer while the side surface includes a seal region surrounding the support plate. The wafer carrier further includes a seal disposed on the seal region and a flexible support membrane encasing the support plate. The flexible support membrane covers the second major support plate surface and extends below the support plate. The seal is configured to improve sealing of the wafer carrier unit to reduce vacuum pressure leakage.

In other embodiment, a device includes a wafer carrier unit of a CMP tool which includes a support plate having a first and second major support plate surfaces and a side surface. The second major support plate surface serves as a surface which supports the wafer while the side surface includes a seal region surrounding the support plate and a clamp region disposed below the seal region distal from the second major support plate surface. The wafer carrier unit further includes a seal disposed on the seal region, a flexible support membrane encasing the support plate to cover the second major support plate surface and extend below the support plate and a membrane clamp which clamps the flexible support membrane to the clamp region of the support plate. The seal is configured to improve sealing of the wafer carrier unit to reduce vacuum pressure leakage.

These and other advantages and features of the embodiments herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily drawn to scale, emphasis is instead generally being placed upon illustrating the principles of the invention. In the following description, various embodiments of the present invention are described with reference to the following drawings, in which.

DETAILED DESCRIPTION

Figure 1:
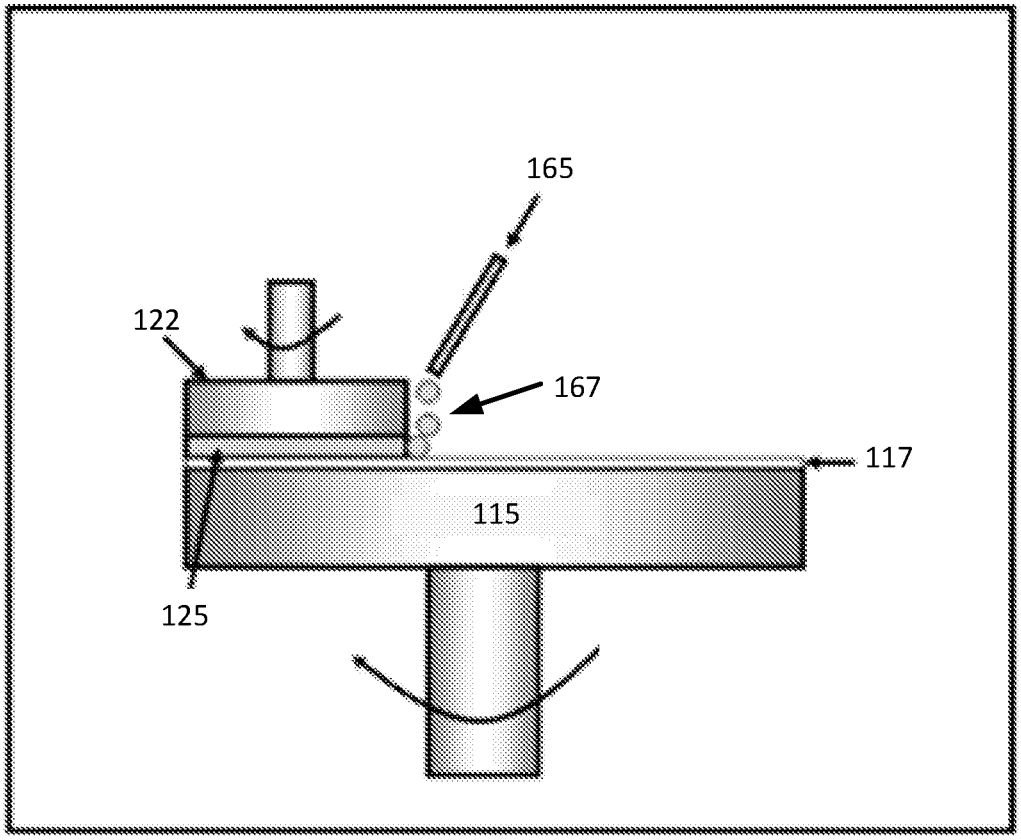
FIG. 1 shows an exemplary embodiment of a CMP polishing tool.

FIG. 1 shows an exemplary embodiment of a chemical mechanical polishing (CMP) tool 100 in operation. As shown, the CMP tool includes a rotating flat plate or platen 115. The platen, for example, is configured to rotate in a clockwise direction. Providing a platen which rotates in a counterclockwise direction may also be useful. The platen is covered with a polishing pad 117. The CMP tool includes a carrier or polishing head assembly 122. The polishing head assembly is configured to hold a wafer 125 in position against the polishing pad. For example, an inactive surface (e.g., the surface which is not to be polished) is mounted onto the polishing head assembly while the active surface (e.g., the surface which is to be polished) is pressed against the pad. In addition, the polishing head assembly is configured to oscillate or rotate. In one embodiment, the polishing head is configured to rotate in the same direction as the platen. A slurry dispenser 165 is configured to dispense a slurry 167 onto the polishing pad proximate to the polishing head assembly.

In operation, the polishing head assembly picks up a wafer for polishing. For example, an inactive surface of the wafer is mounted onto the polishing head assembly by, for example, vacuum pressure. The platen and head assembly are rotating, for example, in a clockwise direction and the slurry dispenser dispenses slurry onto the pad. The head assembly presses the active surface of the wafer onto the polishing pad with the slurry to polish the active surface of the wafer. The head assembly includes pressure controls for controlling the downward pressure of the wafer against the pad. The pressure can be controlled locally to ensure planarity of the polishing process.

Figure 2A:
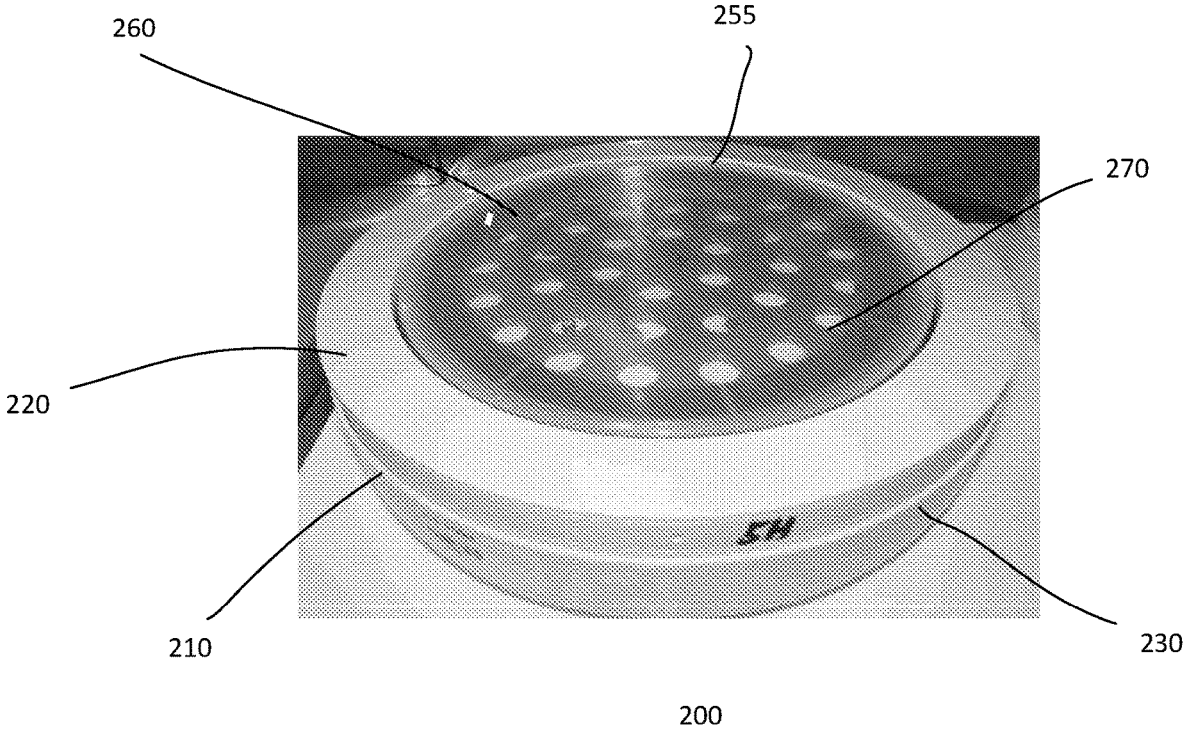
FIGS. 2*a*-2*b* show external and cross-sectional views of an exemplary embodiment of a CMP polishing head module.
Figure 2B:
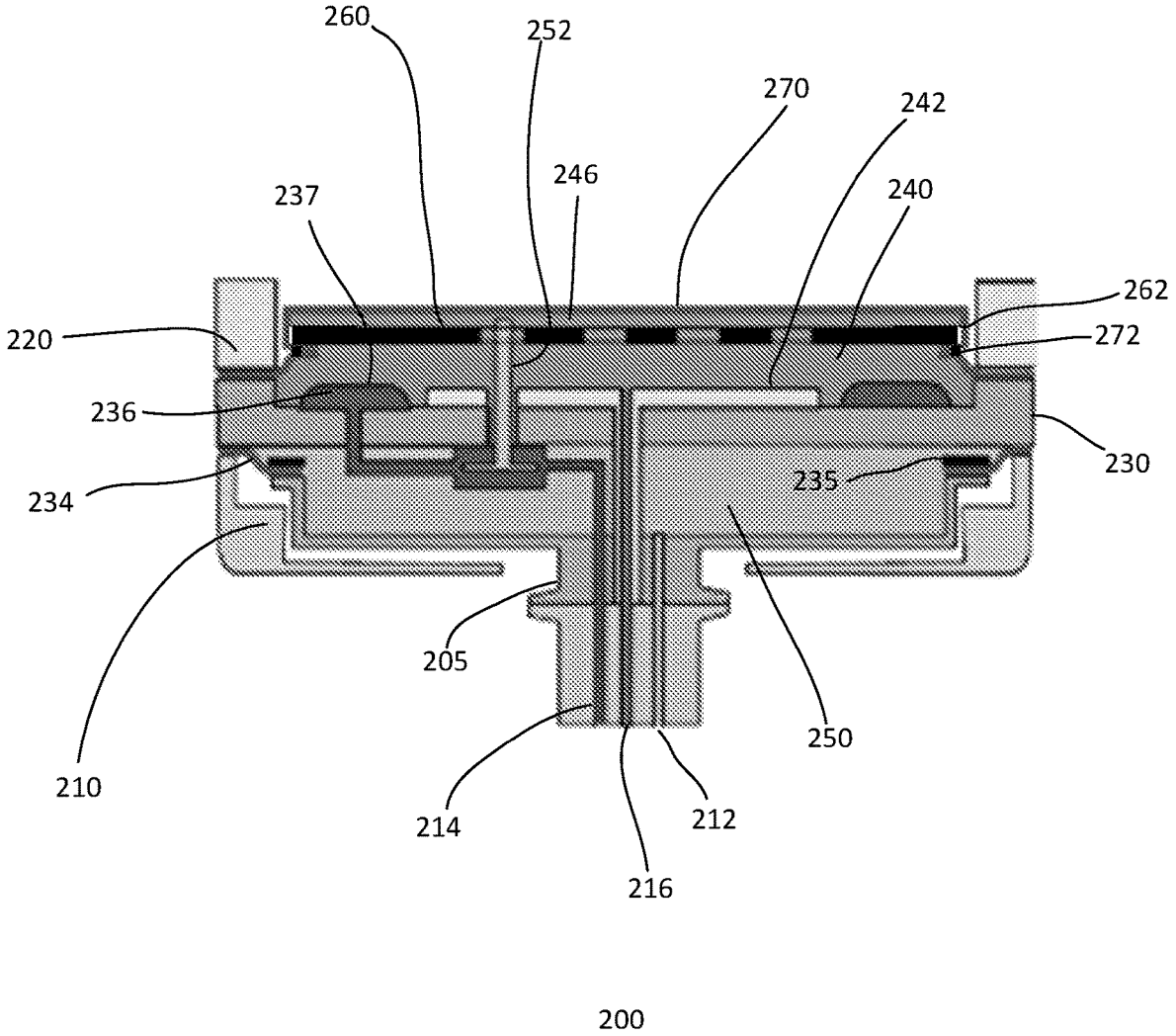

FIGS. 2*a*-2*b* show simplified external and simplified cross-sectional views of an exemplary embodiment of a CMP polishing head module 200. As shown in FIGS. 2*a*-2*b*, the head module may have a circular shape. The circular shape, for example, corresponds to the circular shape of the wafer to be polished. The circular shape also facilitates rotation of the polishing head module.

The CMP polishing head module includes a housing 205. The housing is generally circular in shape and may include a cavity. For example, the housing may include housing sidewall and housing bottom which define the housing cavity. The housing includes various inlets for pneumatically controlling the polishing head module. The housing can be coupled to a drive shaft to rotate the polishing head module during polishing.

A rolling diaphragm 234 is attached to the housing. The rolling diaphragm is a ring-shaped diaphragm and is formed of a flexible sealing material, such as silicone. Other types of flexible sealing materials may be used. In one embodiment, an inner edge of the rolling diaphragm is attached to the housing sidewall by, for example, an inner ring clamp 235.

The module includes a base 230. The base is a ring-shaped base and is formed of a rigid material. For example, the base may be formed of aluminum, steel or other rigid materials. An outer edge of the rolling diaphragm is attached to the base. For example, the outer edge of the rolling diaphragm is attached to a circumference of a first major surface of the base by an outer clamp ring 210. The rolling diaphragm serves to seal the space between the housing and the base, defining a loading chamber 250. A loading chamber control inlet 212 provides fluid communication to the loading chamber by an external load chamber control pump, which controls the pressure in the loading chamber and thereby controls the load applied to the base.

The module also includes a flexure plate 242. The flexure plate secures the base to the housing. As shown, the plate of the flexure plate is securely mounted on a second surface of the base while a rod portion is fixed to the housing. Rotating the housing causes the plate base to rotate as well. The base together with the outer clamp ring and the flexure plate form the lower assembly of the CMP polishing head module.

A wafer carrier unit 255 is attached to the second major base surface. The wafer carrier unit includes a support plate 260. The support plate, in one embodiment, is a perforated plate which includes openings extending through first and second major support plate surfaces. A flexible membrane 270 encases the support plate. The flexible membrane, for example, may be a silicone membrane. Other types of flexible membranes may also be useful. As shown, the flexible membrane covers the second support plate surface and extends below the support plate. The portion below the support plate extends outwardly from the support plate, forming a membrane extended portion. In one embodiment, the flexible membrane is fixed to the support plate by a membrane clamp ring 272. The membrane extended portion is mounted to the circumference of the second major base surface by a retainer ring 220. The wafer carrier unit, which includes the support plate, the flexible membrane and the retainer ring, forms the upper assembly of the CMP polishing head module. The space between the second major base surface and the first major support plate surface defines a pressurizable chamber 240. As for the space between the second major support plate surface and the inner surface of the flexible membrane, it defines a wafer pressure chamber 246. The wafer pressure chamber and the pressurizable chamber are coupled via the openings in the support plate.

A pressurization chamber control inlet 216 is in fluid communication with an external pump, such as a pressurization chamber control pump. The pressurization chamber control pump controls the pressure in the pressurizable and wafer pressure chambers. For example, the pump controls the pressure to either cause the flexible membrane to press the wafer against the pad during polishing or act as a vacuum to pick up wafer for transfer.

The loading chamber includes a bladder membrane 237 attached to the second major base surface to form a bladder 236. The bladder membrane, for example, may be an elastic and flexible membrane. Attaching the bladder membrane to the base may be achieved using a clamp or clamp ring. The bladder is in fluid communication with a bladder control inlet 214, which is coupled to an external bladder control pump. The control pump includes air pressure regulator and valves which control the bladder to provide refined control of the pressure onto the support structure.

The loading chamber includes a wafer sensor 252. The wafer sensor includes a plunger which is in contact with an inner tube configured to facilitate fluid communication between the bladder and the bladder control inlet. The plunger extends from the loading chamber to the wafer pressure chamber and serves to detect the presence of a wafer on the wafer carrier unit. For example, when a wafer is transferred to the carrier unit, pressure exerted on the wafer pressure chamber presses on the plunger which in turn exerts on the inner tube and changes the pressure of the bladder chamber. The wafer sensor detects the presence of a wafer on the wafer carrier unit during the process of loading or before and after the process of polishing.

In one embodiment, the side of the support plate includes a seal 262 to improve sealing of the wafer pressure chamber. The seal, in one embodiment, is a liner film which is disposed on the side of the support plate. In one embodiment, the liner film is disposed on the side of the support plate above where the clamp ring attaches the membrane to the support plate. The liner film, for example, conforms to the profile of the support plate. For example, the liner film may have discontinuities, such as in slots for aligning or accommodating the flexible membrane.

In one embodiment, the liner film, for example, is an adhesive tape with sealing features. For example, the liner film is formed of PU material. The liner film can be configured to be disposed on the side of the support plate by an adhesive backing. The adhesive backing is disposed on one side of the liner film. In one embodiment, the glue tape can be used as the adhesive backing. The liner film has a thickness which is sufficient to improve sealing of the wafer pressure chamber. For example, the thickness of the liner film may be about 0.55 mm to 0.65 mm. The glue tape may have a thickness of about 0.231 mm to 0.239 mm.

It is understood that the thickness should be sufficient to improve sealing of the wafer pressure chamber without negatively affecting the fitting of the flexible membrane over the support plate. As for the width, it should have been configured to accommodate the side of the support plate without hindering the attachment of the flexible membrane to the support plate. For example, the width of the liner film may be about 5 mm to 7 mm. The length of the liner film may be about 622 mm to 628 mm.

The seal improves sealing of the wafer pressure chamber, reducing vacuum leakage. Leakage of pressure from the wafer pressure chamber can cause reliability issues, such as wafer slippage during dechucking stage as well as wafer loading issues due to membrane being out of position.

Figure 3:
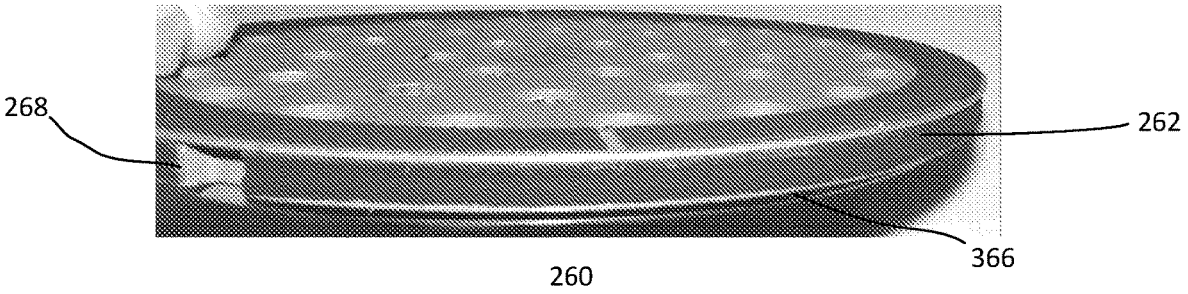
FIG. 3 shows an exemplary embodiment of a support plate with a seal.

FIG. 3 shows a side view of an embodiment of a support plate 260. As shown, the support plate is a perforated plate with openings through the major surfaces thereof. A side of the support plate includes a seal 262. The seal, for example, may be an adhesive liner which is fitted on the sides of the support plate. For example, the seal is disposed in a sealing portion of the support plate. The seal follows the profile contour of the side of the support plate. For example, the seal may include discontinuities 268, such as flexible membrane slots to which the membrane is aligned. In one embodiment, the support plate includes a clamp portion 366 disposed below the sealing portion of the plate. The clamp portion, for example, is where the membrane clamp clamps the membrane to the plate.

Figure 4A:
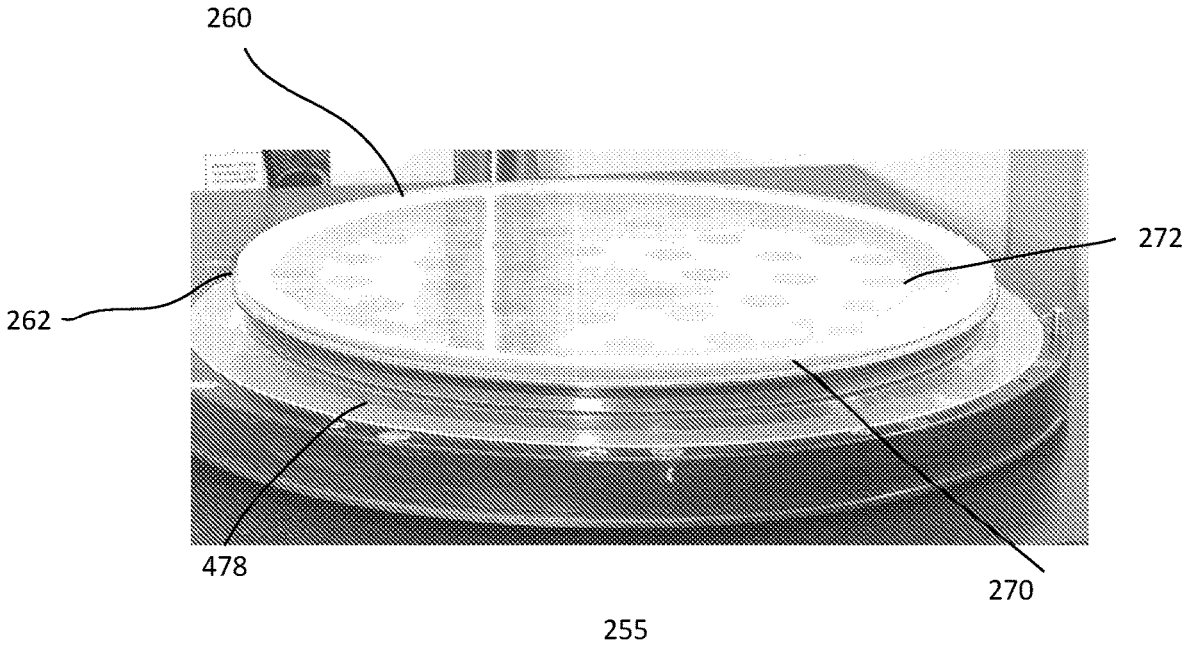
FIGS. 4*a*-4*b* show top and bottom views of an exemplary embodiment of a wafer carrier unit.
Figure 4B:
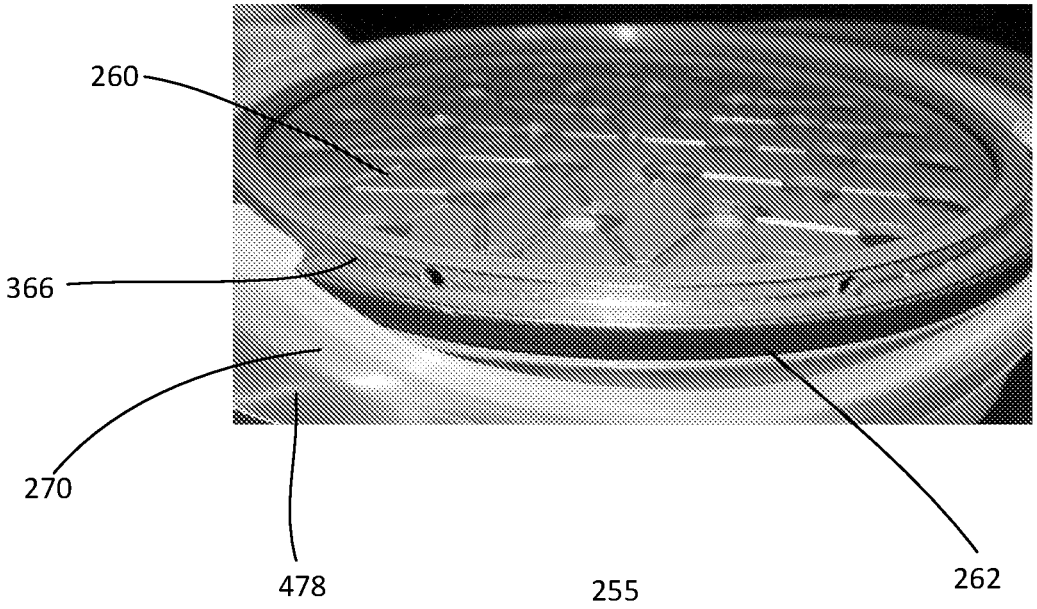

FIGS. 4*a*-4*b* show top and bottom views of an exemplary embodiment of a wafer carrier unit 255. Referring to FIGS. 4*a*-4*b*, the wafer carrier unit includes a support plate 260, such as a perforated plate. The perforated plate includes openings which extend through the first and second major surfaces thereof. A flexible membrane 270 encases the support plate. The flexible membrane includes a portion below the support plate which extends outwardly from the support plate, forming a membrane extended portion 478. The flexible membrane is fixed to the support plate by a membrane clamp ring 272. The wafer pressure chamber and the pressurizable chamber are coupled via the openings in the support plate.

As shown, the support plate includes a seal 262 which is disposed on the sidewall thereof. In one embodiment the seal is disposed between a second major support surface and a clamp portion 366 of the support plate. The portion in which the seal is disposed may be referred to as the seal portion of the support plate. The seal conforms to the profile or contour of the seal portion of the support plate. For example, the seal may include discontinuities, such as flexible membrane slots to which the membrane is aligned.

The invention may be embodied in other forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

The invention claimed is:

1. A method of processing a wafer on which a plurality of devices is formed, the method comprising:

loading the wafer onto a polishing head assembly of a CMP tool for polishing the wafer, the polishing head assembly includes a wafer carrier unit on which the wafer is loaded, wherein the wafer carrier unit comprises:

a support plate having a first and second major support plate surfaces and a side support plate surface, the second major support plate surface serves as a surface which supports the wafer, the side support plate surface includes a seal region surrounding the support plate, a seal disposed on the seal region of the side support plate surface, wherein the seal comprises a liner film or an adhesive tape, a flexible support membrane encasing the support plate, the flexible support membrane covers the second major support plate surface and the side support plate surface, and wherein the flexible support membrane extends below the side support plate surface, wherein the flexible support membrane and the second major support plate surface form a pressure chamber, and wherein the flexible support membrane, the seal and support plate are distinct components; and polishing the wafer by the CMP tool, wherein the seal is configured to improve sealing of the pressure chamber to reduce vacuum pressure leakage during polishing of the wafer to improve polishing uniformity of the wafer; and unloading the wafer from the polishing head assembly, wherein the seal which is disposed on the seal region of the side support plate surface improves vacuum pressure sealing of the pressure chamber to reduce damaging the wafer during loading, polishing, and unloading.

2. The method of claim 1, wherein the support plate of the wafer carrier unit further comprises:

a clamp region, the clamp region is disposed below the seal region away from the second major support plate surface; and a support membrane clamp ring for clamping the flexible support membrane to the clamp region of the support plate.

3. The method of claim 2, wherein the polishing head assembly further comprises:

a base having first and second major base surfaces, the first major base surface includes a cavity;

a retainer ring;

the flexible support membrane includes a lower portion below the clamp region, the lower portion of the flexible support membrane extends outwardly to form an extended portion; and wherein the retainer ring clamps the extended portion to the first major base surface surrounding the base cavity, defining:

a pressurizable chamber between the base and the first major support plate surface, and the pressure chamber between the flexible support membrane and the second major support plate surface.

4. The method of claim 3, wherein the support plate comprises a perforated support plate, the perforated support plate includes plate openings through the first and second major support plate surfaces to provide pressure communication between the pressure chamber and pressurizable chamber.

5. The method of claim 1, wherein the support plate comprises a perforated support plate, the perforated support plate includes plate openings through the first and second major support plate surfaces.

6. The method of claim 3, wherein the polishing head assembly further comprises:

a housing having a first and second major housing surfaces, the housing is configured to have a housing cavity;

a lower retainer ring;

a flexible rolling membrane having an inner rolling membrane edge and an outer rolling membrane edge, wherein the inner rolling membrane edge is clamped to the first major housing surface surrounding the housing cavity; and wherein the lower retainer ring clamps the outer rolling membrane edge to the first major base surface to define a loading chamber between the housing and the base.

7. The method of claim 6, wherein the housing comprises a central portion, the central portion:

is configured to be coupled to a drive shaft for rotating the polishing head assembly; and includes a plurality of inlets for pneumatically controlling the polishing head assembly during polishing.

8. The method of claim 1, wherein the seal comprises a PU material.

9. The method of claim 1, wherein the seal conforms to a profile of the seal region of the support plate.

10. The method of claim 1, wherein the polishing head assembly further comprises:

a base having first and second major base surfaces, the first major base surface includes a cavity;

a housing having a first and second major housing surfaces, the housing is configured to have a housing cavity;

a lower retainer ring;

a flexible rolling membrane having an inner rolling membrane edge and an outer rolling membrane edge, wherein the inner rolling membrane edge is clamped to the first major housing surface surrounding the housing cavity; and wherein the lower retainer ring clamps the outer rolling membrane edge to the first major base surface to define a loading chamber between the housing and the base.

11. The method of claim 1 further comprises dicing the wafer to singulate the plurality of devices on the wafer after completion of wafer processing.

12. A polishing head assembly of a CMP tool comprising a wafer carrier unit on which a wafer is loaded for polishing and unloaded after polishing, wherein the wafer carrier unit comprises:

a support plate having a first and second major support plate surfaces and a side support plate surface, the second major support plate surface serves as a surface which supports the wafer, the side support plate surface includes a seal region surrounding the support plate;

a seal disposed on the seal region of the side support plate surface, wherein the seal comprises a liner film or an adhesive tape;

a flexible support membrane encasing the support plate, the flexible support membrane covers the second major support plate surface and the side support plate surface, and wherein the flexible support membrane extends below the side support plate surface, wherein the seal, the support plate and the flexible support membrane are distinct components; and wherein the seal is configured to improve sealing of the wafer carrier unit to reduce vacuum pressure leakage of a pressure chamber formed between the second major support plate surface and the flexible support membrane to reduce damaging the wafer during processing of the wafer.

13. The polishing head assembly of claim 12, wherein the support plate of the wafer carrier unit further comprises:

a clamp region, the clamp region is disposed below the seal region away from the second major support plate surface; and a support membrane clamp ring for clamping the flexible support membrane to the clamp region of the support plate.

14. The polishing head assembly of claim 13 further comprises:

a base having first and second major base surfaces, the first major base surface includes a cavity;

a retainer ring;

the flexible support membrane includes a lower portion below the clamp region, the lower portion of the flexible support membrane extends outwardly to form an extended portion; and wherein the retainer ring clamps the extended portion to the first major base surface surrounding the base cavity, defining:

a pressurizable chamber between the base and the first major support plate surface, and the pressure chamber between the flexible support membrane and the second major support plate surface.

15. The polishing head assembly of claim 14, wherein the support plate comprises a perforated support plate, the perforated support plate includes plate openings through the first and second major support plate surfaces to provide pressure communication between the pressure chamber and pressurizable chamber.

16. A wafer carrier unit of a CMP tool comprising:

a support plate having a first and second major support plate surfaces and a side support plate surface, the second major support plate surface serves as a surface which supports the wafer, the side support plate surface includes a seal region surrounding the support plate and a clamp region disposed below the seal region;

a seal disposed on the seal region of the side support plate surface, wherein the seal comprises a liner film or an adhesive tape;

a flexible support membrane encasing the support plate, the flexible support membrane covers the second major support plate surface and the side support plate surface, and wherein the flexible support membrane extends below the side support plate surface, wherein the flexible support membrane, the seal and the support plate are distinct components;

a membrane clamp which clamps the flexible support membrane to the clamp region of the support plate; and wherein the seal is configured to improve sealing of a pressure chamber between the second major support plate surface and flexible support membrane to reduce vacuum pressure leakage of the pressure chamber during processing of the wafer.

* * * * *